US005657581A

United States Patent [19]

Husting

[11] Patent Number: 5,657,581

[45] Date of Patent: Aug. 19, 1997

[54] MULTIPLE SECTION SUSPENDED BATH DOORS WITH INTERLOCKING MEMBERS

[75] Inventor: Thomas J. Husting, Sheboygan Falls, Wis.

[73] Assignee: Kohler Co., Kohler, Wis.

[21] Appl. No.: 428,601

[22] Filed: Apr. 25, 1995

Related U.S. Application Data

[63] Continuation-in-part of Ser. No. 377,895, Jan. 25, 1995.

[51] Int. Cl.[6] ..... E05F 13/00; E05F 15/06

[52] U.S. Cl. ..... 49/409; 49/411; 4/607

[58] Field of Search ..... 49/409, 410, 411, 49/125, 225, 209; 4/607, 557, 610

[56] References Cited

U.S. PATENT DOCUMENTS

| | | | |
|---|---|---|---|
| 1,383,052 | 6/1921 | Allmand . | |
| 2,274,730 | 3/1942 | Owen | 189/64 |
| 2,751,637 | 6/1956 | Kraft | 20/19 |
| 2,793,406 | 5/1957 | Focht | 20/69 |
| 2,850,089 | 9/1958 | Burke | 160/202 |
| 2,895,183 | 7/1959 | Dumbolton | 49/125 X |
| 3,100,916 | 8/1963 | McKinney | 49/410 X |
| 3,384,998 | 5/1968 | Abramson | 49/411 |
| 3,461,466 | 8/1969 | Weaver et al. | 4/149 |
| 3,783,456 | 1/1974 | Doan | 4/149 |
| 3,805,450 | 4/1974 | Forcina | 49/231 |
| 3,896,508 | 7/1975 | Doan | 4/149 |
| 3,947,998 | 4/1976 | Matsubara | 49/209 |
| 4,004,629 | 1/1977 | Kelly | 160/90 |
| 4,014,070 | 3/1977 | Rifkin | 49/410 X |
| 4,090,265 | 5/1978 | Baus | 4/154 |
| 4,114,317 | 9/1978 | Crawley | 49/209 |
| 4,245,614 | 1/1981 | Hurwitz et al. | 49/410 X |
| 4,358,863 | 11/1982 | Jacobsen | 4/607 |
| 4,445,239 | 5/1984 | Jacobsen | 4/607 |
| 4,458,449 | 7/1984 | Breuer | 49/411 |
| 4,785,485 | 11/1988 | Etesam | 4/557 |
| 4,882,795 | 11/1989 | Baus | 4/607 |
| 5,297,301 | 3/1994 | Sodrel | 4/613 |
| 5,461,829 | 10/1995 | Lehto et al. | 49/225 X |

FOREIGN PATENT DOCUMENTS

| | | | |
|---|---|---|---|
| 26 01 728 | 7/1977 | Germany . | |
| 28 09 404 | 9/1979 | Germany . | |
| 29 12 126 | 10/1980 | Germany . | |
| 8507810 U | 6/1985 | Germany . | |
| 4008160 | 9/1991 | Germany | 4/607 |

*Primary Examiner*—Kenneth J. Dorner
*Assistant Examiner*—Curtis Cohen
*Attorney, Agent, or Firm*—Quarles & Brady

[57] ABSTRACT

A door system includes a sill with a ledge extending across the bottom of an opening to a bathing enclosure and with a raised lip along an exterior side of the ledge. A pair of parallel tracks are above the opening with a first door suspended from and freely slidable along the first track above the ledge. A second door and a third door are suspended from and slidable along the second track being freely suspended above the ledge. A pair of door guides are attached to the first door and engage the other doors to prevent the doors from swinging into each other. Similar door guides are attached to the second and third doors and interlock with one of the door guides on the first door to prevent the doors from sliding entirely past each other. A stop member is attached to the sill and retains the doors above the ledge between the stop member and the raised lip. Detent blocks also are disclosed for holding the doors in a closed state.

23 Claims, 5 Drawing Sheets

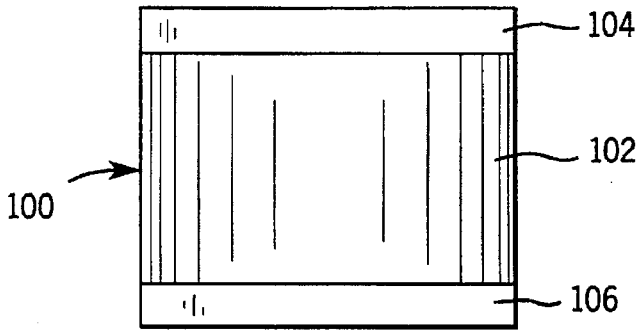
FIG. 12
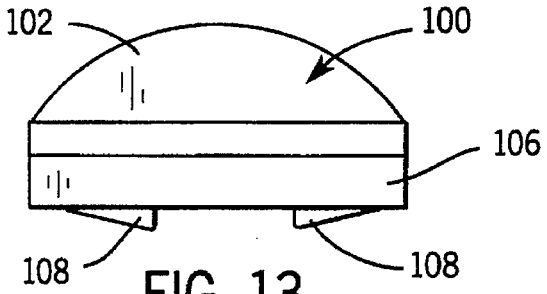
FIG. 13
FIG. 14
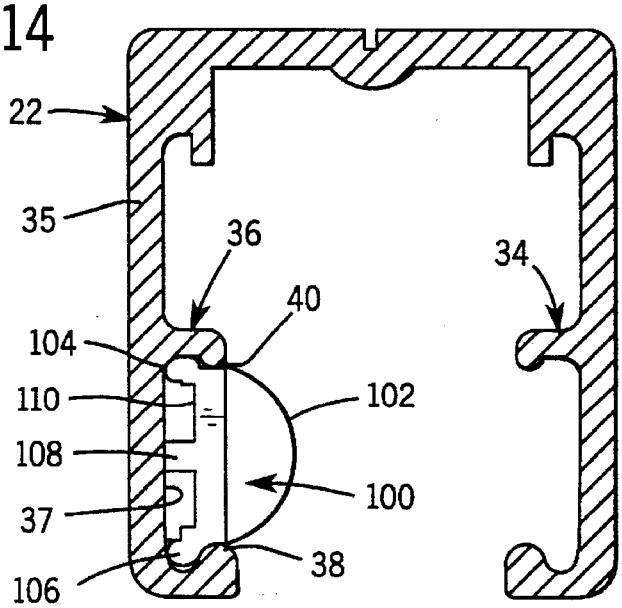

MULTIPLE SECTION SUSPENDED BATH DOORS WITH INTERLOCKING MEMBERS

This application is a continuation in part of U.S. patent application Ser. No. 08/377,895 filed Jan. 25, 1995.

BACKGROUND OF THE INVENTION

The present invention relates to sliding doors of the type commonly used as part of a shower or tub enclosure; and more particularly to multiple section shower/tub enclosure doors that are suspended from and slidable along an overhead track.

Tub and shower enclosures often have an opening that is closed with a pair of sliding doors. A common door assembly has a lower track mounted on the rim of the tub or shower pan and another track mounted directly overhead. Each door slides in a separate channel within the tracks and is able to slide past the other door. One of the drawbacks of this type of mechanism is that the lower track is an impediment to a bather entering and leaving the enclosure. The sharp edges of the lower track are undesirable to step upon and those edges also can scrape the feet of the bather. Thus, it is desirable to eliminate the use of a lower track.

However, the lower track provides several functions. Not only does it aid in guiding movement of the doors, but the lower track also restricts the doors from swinging inward and outward. Extreme inward or outward movement could dislodge the doors from the overhead track mechanism. Furthermore, the lower track provides a water barrier which directs water flowing against the doors into the tub or shower enclosure preventing water from flowing outward. Thus, eliminating the lower track of the door assembly also eliminates these beneficial functions provided by that track.

SUMMARY OF THE INVENTION

The general object of the present invention is to provide a sliding door assembly for a tub or shower enclosure which does not require a lower track.

Another object is to provide such a door assembly in which the doors slide along an overhead track, and which incorporates a mechanism that restricts inward and outward movement of the lower edges of the doors.

A further object of the present invention is to provide a sill at the tub or shower enclosure opening which has a recess along an inner edge within which the doors are suspended. A raised lip on the outer side of the recess acts as a barrier to water passing under the doors and also directs water back into the bathing enclosure.

These objects are fulfilled by a door system for a bathing enclosure which includes a track assembly extending above the opening. A pair of doors with glass panels are suspended from and slidable along the track assembly, and are freely suspended above a portion of the sill. A stop member is attached to the sill to retain the door above the portion of the sill.

In the preferred embodiment of the door system, overlapping vertical edges of the doors have panel guides attached thereto. A separate tab projects outward parallel to the edge of each door toward the adjacent door. When the doors are open, the tab from one door abuts the adjacent door to prevent their glass panels from striking together. As the doors are closed, the panel guide tab on one door rides onto the panel guides of the adjacent door pushing the doors apart. This action causes the outer door to abut the raised lip of the sill and the inner door to abut the stop member. Thus the doors in the closed state are wedged between the stop and the sill preventing the doors from swinging inward or outward.

As one door is pulled along the track, the wing on that door interlocks with the wing on an adjacent door. The interlocking prevents the doors from being pulled apart and causes the other door to be pulled along with the one door.

Also described are detent blocks which fit tightly in the ends of the track. In a fully closed position, a door rides onto a domed surface of the detent blocks which wedges the door against a portion of the track. The force produced by the wedging action holds the otherwise freely sliding door in the closed position until the bather pushes the door open. In a three door assembly, the outer doors are held closed by detent blocks and the center door is maintained in the closed position because of the interlocking with each outer door.

BRIEF DESCRIPTION OF THE DRAWINGS

FIG. 12 is a plane view of a detent block;

FIG. 13 is a side view of the detent block; and

FIG. 14 is a cross section view through the overhead track showing the decent block installed.

DETAILED DESCRIPTION OF THE INVENTION

Figure 1:
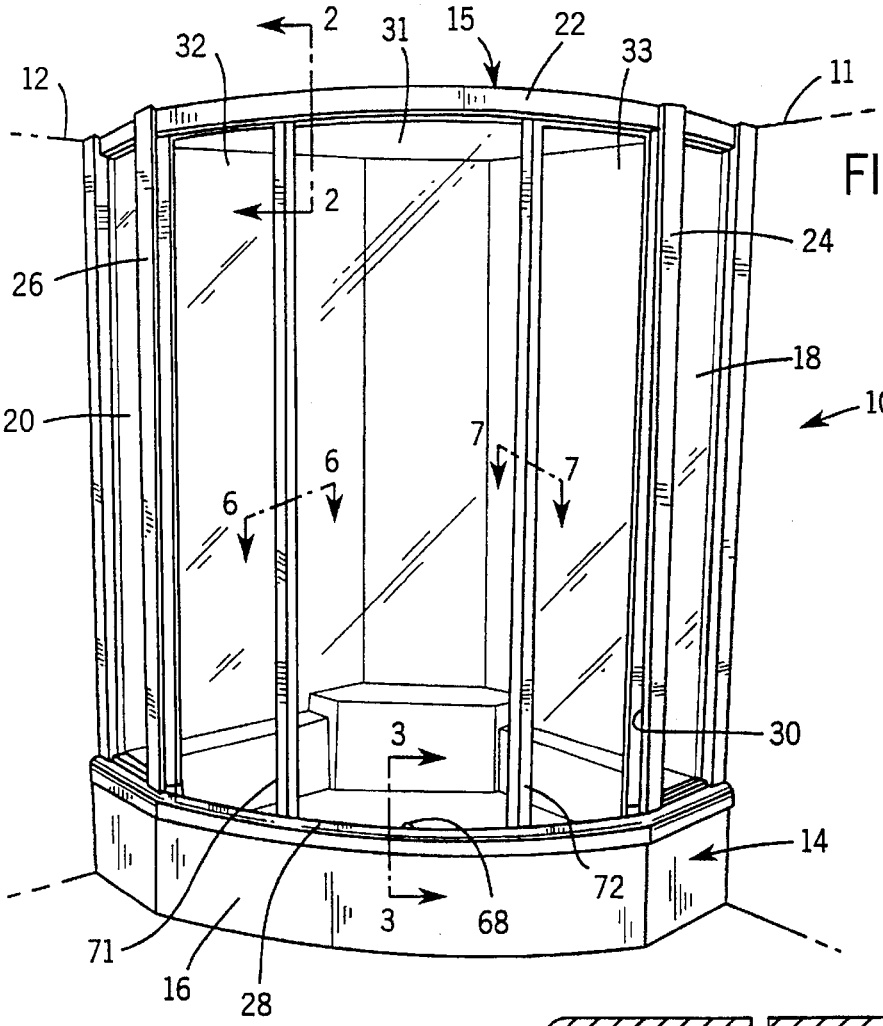
FIG. 1 is a pictorial representation of a corner shower enclosure incorporating a sliding door system according to the present invention.

With initial reference to FIG. 1, a shower enclosure 10 is located in a bathroom corner formed by walls 11 and 12. Although the present door system is being described in the context of a shower enclosure, it also can be applied to tubs and other bathing enclosures, as well as non-corner type enclosures. The shower enclosure 10 includes a floor pan 14 with a raised front barrier 16 extending between the two room walls 11 and 12. A set of stationary glass panels 18, 20 and a sliding door system 15 extend in a curving fashion between the two walls 11 and 12 above the front barrier 16. Specifically, one of the stationary glass panels 18 or 20 is attached to each of the room walls 11 and 12 and is sealed along a bottom edge to the front barrier 16 on the floor pan. The door system 15 includes a curved overhead track 22 which extends between a pair of vertical jambs 24 and 26 on the stationary glass panels 18 and 20. The two jambs 24 and 26 define the side boundaries of an opening 30 into the shower enclosure 10 and the overhead track 22 and a sill 28 of the front barrier 16 define upper and lower boundaries of that opening. A set of three glass-panel doors 31, 32 and 33 are suspended from the overhead track 22 and extend downward to the sill 28 of the floor pan 14. A center door 31 is flanked on both sides by narrower first and second side doors 32 and 33. The three doors 31–33 can slide in either direction along the overhead track 22 to create a passageway adjacent either jamb 24 or 26 through which a bather enters and exits the shower enclosure 10.

Figure 2:
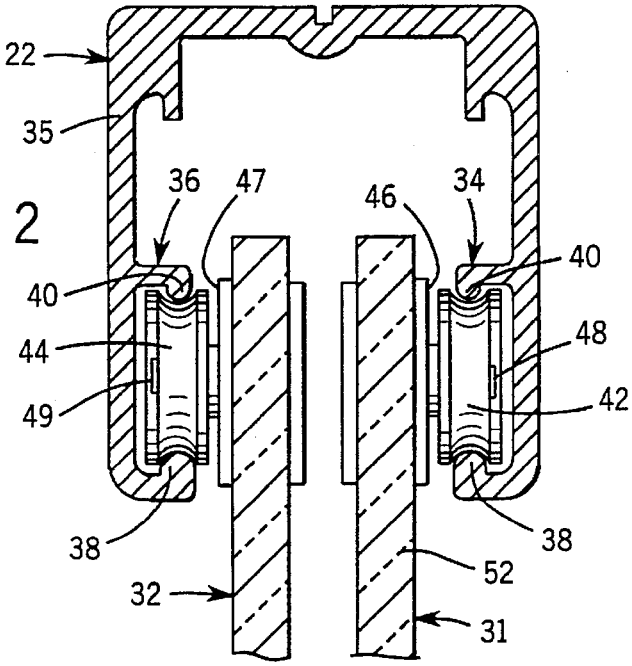
FIG. 2 is a cross-section view along line 2—2 in FIG. 1 through the overhead track of the door system.

With reference to FIG. 2, the curved overhead track 22 is formed by an elongated channel member 35 that has an inverted U-shaped cross section and inner and outer parallel tracks 34 and 36 within the opening of the U. Each track 34 and 36 has a lower rail 38 and an upper rail 40 between which ride pulley-like rollers 42 and 44 connected to the doors. Roller 42 is mounted on an axle 48 which is attached to a fastener 46 that extends through a hole near the top edge of the glass panel 52 of center door 31. The other illustrated roller 44 is mounted on axle 49 that is connected to a fastener 47 that passes through a hole in the first side door 32. Two roller assemblies of this type are located along the top edge of each door 31–33 spaced from the vertical edges of the respective door. The rollers for the two side doors 32 and 33 ride on the outer track 36, while the center door rollers engage the parallel inner track 34.

Figure 3:
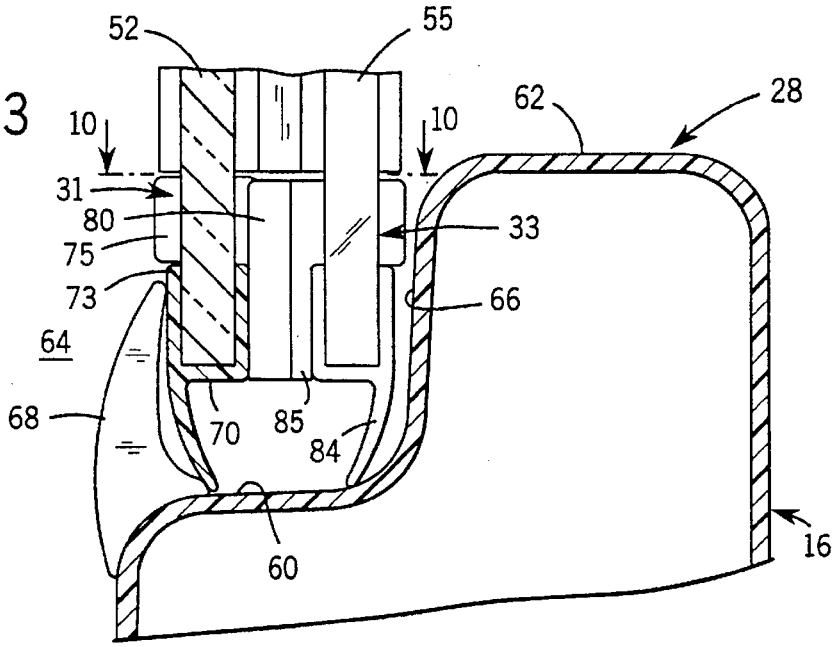
FIG. 3 is a cross-section view along line 3—3 in FIG. 1 through the sill of the shower enclosure.

The three doors 31–33 are freely suspended from the track 22 over the sill 28 of the shower floor pan 14. In other words, there is no lower track mechanism mounted on the sill 28 within which the doors 31–33 ride. With reference to FIG. 3, the sill 28 of the floor pan 14 has a generally horizontal ledge 60 and a raised lip 62 which extends along the ledge 60 on the exterior side of the sill 28. The two illustrated doors 31 and 33, as well as the other door 32, extend downward past the upper surface of the raised lip 62 into the recessed region formed by the lower ledge 60 and vertical lip wall 66. This recessed region extends along the interior edge of the sill 28 between the two vertical jambs 24 and 26. Because the sliding doors 31–33 extend below the horizontal upper surface of the raised lip 62, any water striking the inside surfaces of the doors flows downward onto ledge 60 and is directed into the shower enclosure chamber 64. The raised lip 62 on the outside of the sill 28 forms a barrier which prevents water from flowing under the doors 31–33 and onto a floor of the shower enclosure 10.

Figure 4:
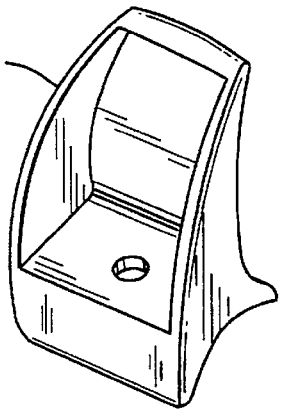
FIG. 4 is an isometric illustration of a stop member shown in FIG. 3.

As noted previously, the three sliding doors 31–33 are suspended freely above the ledge 60 of the floor pan sill 28. Because the doors extend below the raised lip 62 of the sill, the inner vertical surface 66 of the lip prevents the doors from swinging laterally outward. However, in the absence of a lower track, an additional mechanism must be provided to prevent the bottom edges of the doors 31–33 from swinging laterally into the shower enclosure chamber 64. Referring to FIGS. 3 and 4, this is accomplished by a narrow stop member 68 that is fastened to the inner edge of ledge 60 at the center of the opening 30 between the two jambs 24 and 26 (see also FIG. 1). The stop member 68 engages a bottom drip edge member 73 of the center door 31 to restrict the inward lateral movement of that door. Because the center door 31 is slightly wider than one-half the width of the enclosure opening 30, the center door 31 never slides past the centrally positioned stop member 68. Thus, in all positions of the center door 31 along the overhead track 22, the center door will strike the stop member 68 upon significant inward lateral movement of the bottom edge 70 of the center door. Furthermore, the center door 31 always is between the entire stop member 68 and the sill lip 62 so that the stop member never is exposed wherein a bather entering or leaving the enclosure 10 could step on the stop member. As a result, the relatively narrow stop member does not present an impediment to the bather moving through the enclosure opening 30.

Figure 5:
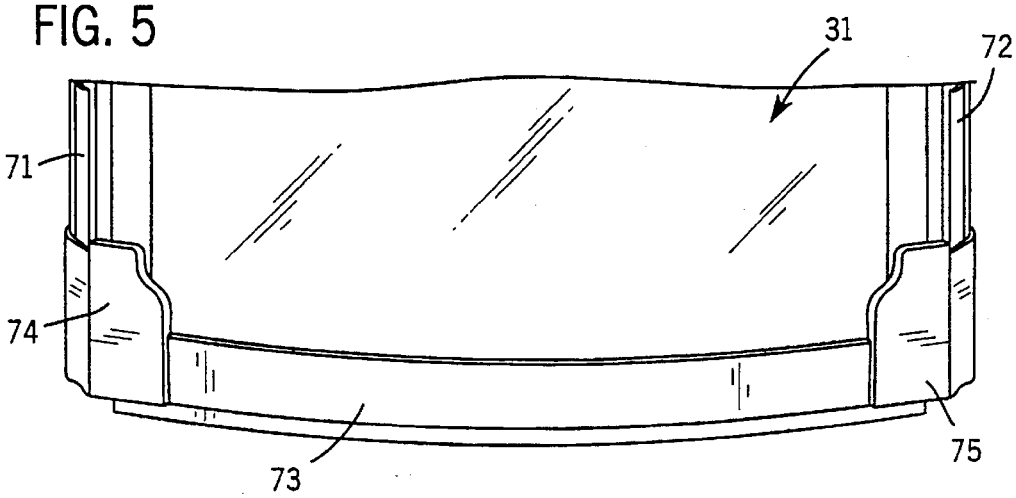
FIG. 5 shows the bottom section of the center door in FIG. 1.
Figure 6:
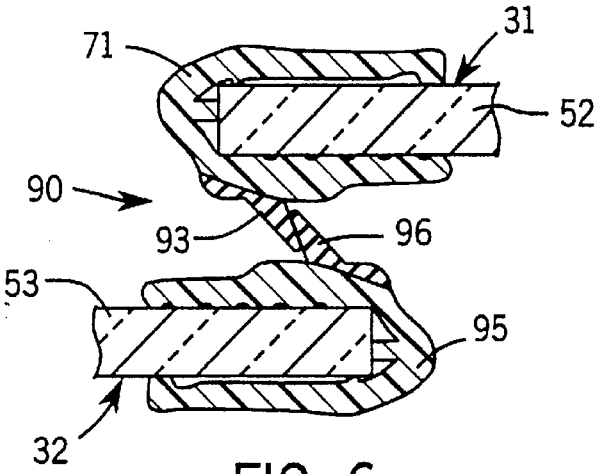
FIG. 6 is a cross-section view along line 6—6 in FIG. 1.

With reference to FIG. 5, the center door 31 has two vertical side frame members 71 and 72 which interlock with similar side frame members of the side doors 32 and 33, respectively. This interlocking of the side frame members prevents the center door 31 from sliding beyond each of the two side doors 32 or 33. The interlock mechanism 90 between the center door 31 and first side door 32 is shown in detail in FIG. 6. The center door 31 has a glass panel 52 with a side frame member 71, that is formed of a rigid poly-vinyl chloride compound, having a U-shaped cross-section which tightly grips a vertical edge of the center door 31. On the exterior side of the side frame member 71 is a first wing 93 formed of a resilient plastic or rubber material. The first wing 93 projects at an angle toward the exterior of the shower enclosure 10. The first side door 32 has another side frame member 95 attached along the vertical edge of its glass panel 53 which is remote from jamb 26. A second resilient wing 96 projects from the interior side of side frame member 95 and is pointed toward the interior of the shower enclosure 10. The vertical edge of center door 31 that is proximate to jamb 26 and the vertical edge of first side door 32 that is remote from jamb 26 overlap so that the wings 93 and 96 interlock when these doors are pulled away from each other as shown in FIG. 6.

This interlocking relationship prevents the center door 31 from sliding to the right in FIG. 1 entirely past the edge of the first side door 32. When a bather pulls on the first side door 32, the center door 31 is dragged along when the wings 93 and 96 interlock. The interlocking of the wings 93 and 96 also prevents the first side door 32 from sliding out of the channel in door retainer 75. However, the interlocking mechanism does not restrict the first and second side doors 32 and 33 from sliding into an overlapping relationship with the center door 31 to provide a passageway within opening 30 through which the bather can ingress and egress the enclosure 10.

In the fully closed state of the doors illustrated in FIG. 1, the interlocking or near interlocking wings 93 and 96 provide a barrier to water flowing out of enclosure 10 between the two door frame members 71 and 95. Thus, any water that is directed between the doors 31 and 32 will be deflected back into the shower enclosure 10.

Figure 7:
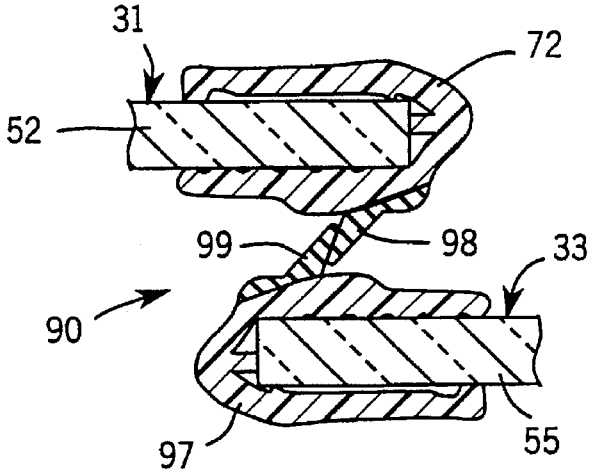
FIG. 7 is a cross section view along line 7—7 in FIG. 1.

As shown in FIG. 7, similar door frame members 72 and 97 are provided on the overlapping vertical edges of the center door 31 and the second side door 33. These frame members 72 and 97 have wings 98 and 99, respectively, which serve the same functions as wings 93 and 96.

Figure 8:
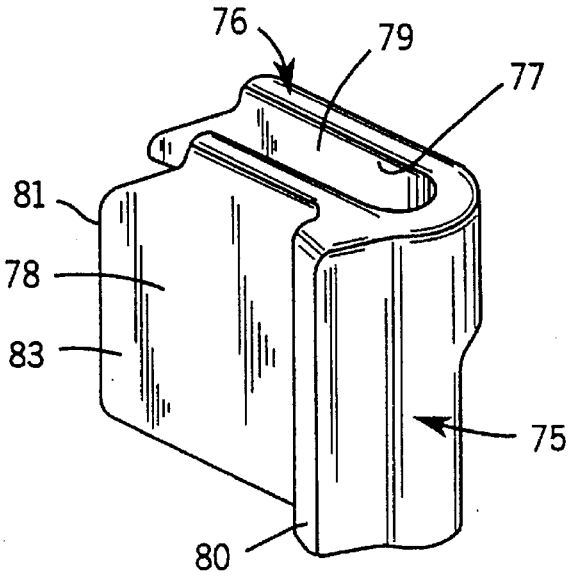
FIGS. 8 and 9 are isometric representations from two different angles of a door panel guide shown in FIG. 3.
Figure 9:
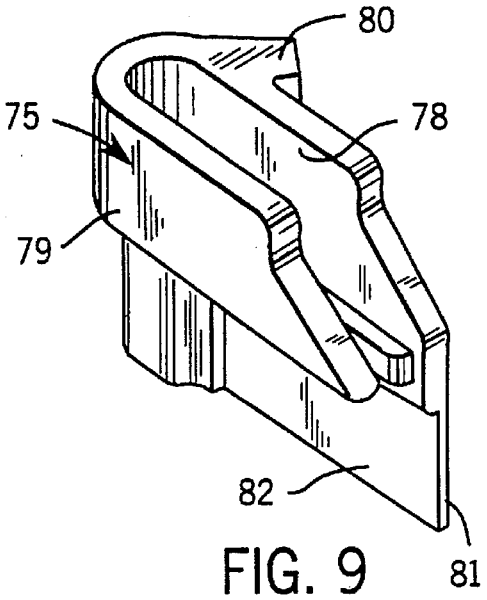

A separate door panel guide 74 and 75 is attached near the bottom of the center door beneath side frame members 71 and 72 as illustrated in FIG. 5. The two door retainers 74 and 75 are similar being mirror images of each other. With reference to FIGS. 3, 8 and 9, door panel guide 75 has a horizontally oriented U-shaped clip 76 with a channel 77 formed between plates 78 and 79. The channel 77 receives the side edge of the center door 31 in a secure manner to firmly attach the door panel guide 75 to that door. A wide tab 80 extends outward at an acute angle from one plate 78 of the door panel guide. The edge 81 of that one plate 70 which is at the end of the U-shaped channel 77 is beveled so that the inner surface 82 of the plate extends beyond the boundary of the outer surface 83. The bevel aids in the door panel guide of adjacent doors to slide across each other, as will be described.

Figure 10:
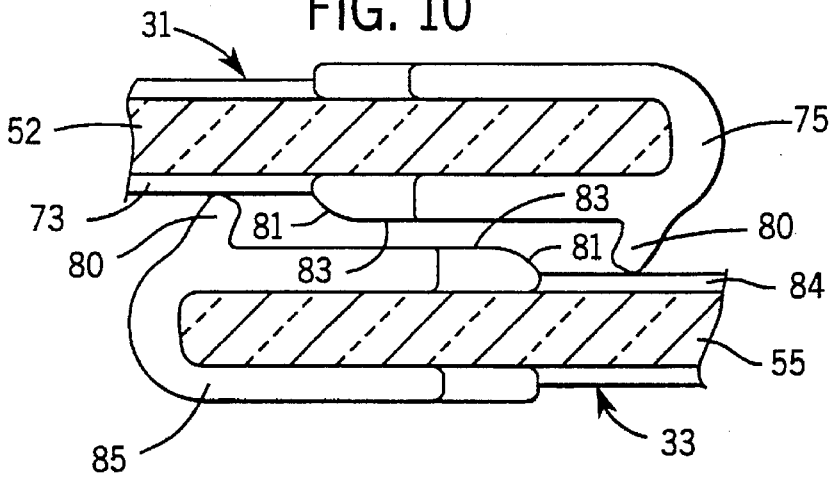
FIG. 10 is a cross section view along line 10—10 in FIG. 3 with the doors in a slightly opened state.

FIG. 3 illustrates adjacent doors 31 and 33 in a state in which the enclosure is opened. In this state, which also is depicted in FIG. 10, the tab 80 of door panel guide 75 on the center door 31 abuts the bottom drip edge 84 on side door 33, and the tab 80 of door panel guide 85 on the side door 33 abuts the bottom drip edge 73 of the center door. Therefore the two door panel guides 75 and 85 maintain the glass panels 52, 53 and 55 of the center and side doors spaced apart and prevent the glass from striking together. As one of these doors 31 and 33 is slid along the overhead track 22 the two door panel guides 75 and 85 guide the movement of the lower sections of the doors.

Figure 11:
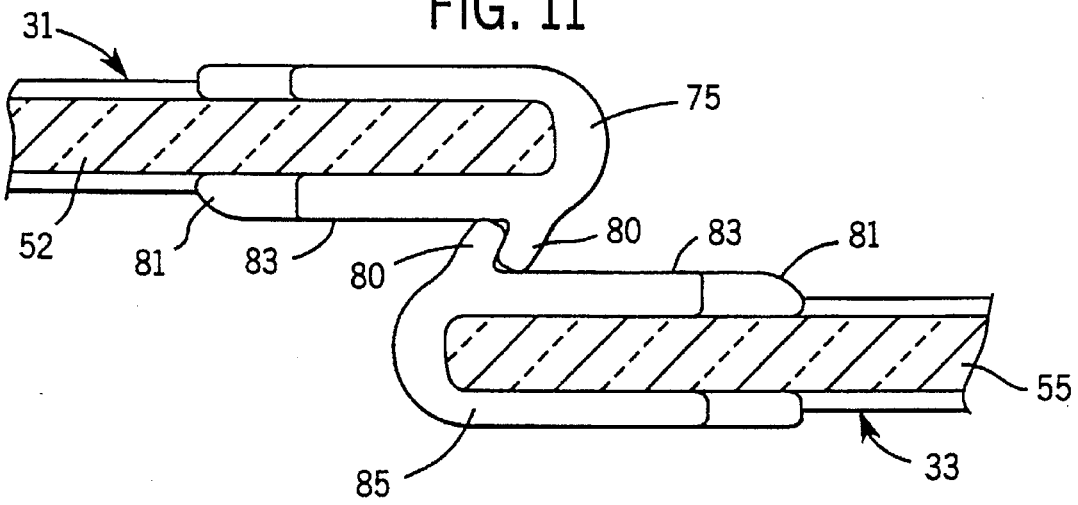
FIG. 11 is a cross section similar to FIG. 10 with the doors in a fully closed state.

As the two doors move into a closed state, the tabs 80 of their respective door panel guides 75 and 85 engage the beveled edges 81 of the adjacent door panel guide and slide onto the outer surface 83 of that other door panel guide. This action forces the doors 31 and 33 apart whereby the bottom drip edge member 84 on side door 33 strikes the vertical lip wall 66 of sill 28 and the bottom drip edge member 73 on center door 33 strikes the stop 64 as best visualized with respect to FIG. 3, which shows the doors in an open state. Eventually the tabs 80 of the two door panel guides 75 and 85 interlock as shown in FIG. 11 at which point the doors cease moving with respect to each other and may continue to move together.

As a further aid in securing the doors in the closed state, a detent block is inserted into each end of the outer track 36 adjacent to the stationary glass panels 18 and 20. Referring to FIGS. 12–13, each detent block 100 has a rectilinear shape with a domed surface 102 and elongated tabs 104 and 106 extending along opposite sides of the domed surface. A pair of ears 108 project outward from the surface 110 of the detent block 100 that is opposed to the domed surface 102.

The detent block 100 is made of a resilient material, such as a stiff rubber compound, thus enabling the detent block to be squeezed into the outer track 36 of the overhead track 22. When inserted, the tabs 104 and 106 of the detent block tightly fit into the recesses of the track between the rails 38 and 40 and the side wall 37 of the channel member 35. The ears 108 also are compressed against the track side wall 37 exerting force which, along with force exerted against the track by the tabs 104 and 106, hold the detent block 100 in place, preventing movement along the outer track 36.

When one of the side doors 32 or 33 moves into the closed position against the respective stationary glass panel 18 or 20, the vertical edge of the door strikes the domed surface 102 of the detent block 100. As the side door is pulled into the fully closed position the glass panel rides onto the domed surface 102 compressing the detent block 100 against the wall 37 of the overhead track 22. The compression of the detent block exerts force which pushes the side door 32 or 33 toward the inner track 34 which presses the rollers of the side door transversely against the track rails 38 and 40. This creates a transverse force which impedes movement of the side door along the track and maintains that door in the fully closed state until the bather pushes the doors open. With both side doors 32 and 33 held in this fully closed state, the interlocking tabs 80 on the door panel guides 74, 75 and 85 hold the center door 31 in a central closed position in the enclosure opening 30.

I claim:

1. A door system for a bathing enclosure which has an opening with a sill, said door system comprising:

a track assembly extending above the opening and having a first track and a second track which is substantially parallel to the first track;

a first door suspended from and slidable along the first track and suspended above the sill;

a second door suspended from and slidable along the second track and suspended above the sill;

a first door guide attached to said first door and having a first surface with a first tab projecting therefrom toward said second door, the first tab for abutting said second door to maintain said first and second doors spaced apart by at least a first distance;

a second door guide attached to said second door and having a second surface with a second tab projecting therefrom toward said first door, said second tab for abutting the first door to maintain said first and second doors spaced apart by at least the first distance, and wherein the first tab and the second tab engage to prevent said first door from sliding entirely past said second door; and a stop member attached to the sill and retaining said first door above the portion of the sill.

2. The door system recited in claim 1 wherein said stop member is attached to the sill at substantially a center of the opening.

3. The door system recited in claim 1 further wherein said first door guide has a U-shaped clip within which a side edge of said first door is received; and said second door guide has a U-shaped clip within which a side edge of said second door is received.

4. The door system recited in claim 1 having a closed state wherein the first tab abuts the second surface of said second door guide to maintain the first and second doors spaced apart by a second distance greater than the first distance.

5. The door system recited in claim 1 having a closed state wherein the second tab abuts the first surface of said first door guide to maintain the first and second doors spaced apart by a second distance greater than the first distance.

6. The door system recited in claim 1 further comprising: a third door suspended from and slidable along the second track;

a third door guide attached to said first door and having a third first surface with a third tab projecting therefrom toward said third door, the third tab for abutting said third door to maintain said first and third doors spaced apart by at least the first distance;

a fourth door guide attached to said third door and having a fourth surface with a fourth tab projecting therefrom toward said first door, the fourth tab for abutting said first door to maintain said first and third doors spaced apart by at least the first distance, and wherein the third tab and the fourth tab engage to prevent said third door from sliding entirely past said first door.

7. The door system recited in claim 6 having a closed state wherein at least one of the first tab abuts the second surface of said second door guide and the second tab abuts the first surface of said first door guide, to maintain the first and second doors spaced apart by a second distance which is greater than the first distance; and at least one of the third tab abuts the fourth surface of said fourth door guide and the fourth tab abuts the third surface of said third door guide, to maintain the first and third doors spaced apart by the second distance.

8. The door system recited in claim 6 wherein each of said first, second, third and fourth door guides has a U-shaped clip within which a side edge of a respective one of said first, second, third and fourth doors is received.

9. The door system recited in claim 6 further comprising a first wing extending along a vertical edge of said first door, a second wing extending along another vertical edge of said first door, a third wing extending along a vertical edge of said second door, and a fourth wing extending along a vertical edge of said third door; wherein the first wing overlaps the third wing to prevent water from flowing between said first and second doors, and the second wing overlaps the fourth wing to prevent water from flowing between said first and third doors.

10. The door system recited in claim 6 further comprising a first detent block located in said second track and having a surface against which said second door abuts in a closed state thereby forcing said second door against the second track which provides resistance to movement of said second door; and a second detent block located in said second track and having a surface against which said third door abuts in a closed state thereby forcing said third door against the second track which produces resistance to movement of said third door.

11. The door system recited in claim 1 further comprising a first wing extending along a vertical edge of said first door, and a second wing extending along a vertical edge of said second door; wherein the first wing overlaps the second wing to prevent water from flowing between said first and second doors.

12. The door system recited in claim 1 further comprising a detent block located in one of said first track and said second track and having a surface against which one of said first door and said second door abuts in a closed state thereby forcing that one door against the one track which produces resistance to movement of that one door.

13. The door system recited in claim 12 wherein the surface of said detent block is convex.

14. The door system recited in claim 12 wherein said detent block has an outwardly projecting ear that engages said second track to prevent movement of said detent block along said second track.

15. A door system for a bathing enclosure having an opening between two side jambs, said door system comprising:

a sill defining a lower boundary of the opening and having a ledge extending between the side jambs and a raised lip extending along an exterior side of the ledge;

a first track and a second track extending parallel to each other above the opening between the two side jambs;

a first door suspended from and slidable along said first track, and freely suspended above the ledge;

a second door and a third door suspended from and slidable along said second track, and freely suspended above the ledge;

a first door guide attached to said first door and having a first surface with first tab projecting therefrom toward said second door, the first tab for abutting the second door to maintain the first and second doors spaced apart by at least a first distance;

a second door guide attached to second door and having a second surface with second tab projecting therefrom toward said first door, the second tab for abutting the first door to maintain the first and second doors spaced apart by at least the first distance, and wherein the first and second tabs engage to prevent said first door from sliding entirely past said second door;

a third door guide attached to said first door and having a third first surface with third tab projecting therefrom toward said third door, the third tab for abutting the third door to maintain the first and third doors spaced apart by at least the first distance;

a fourth door guide attached to said third door and having a fourth surface with fourth tab projecting therefrom toward said first door, the fourth tab for abutting the first door to maintain the first and third doors spaced apart by at least the first distance, and wherein the third and fourth tabs engage to prevent said third door from sliding entirely past said first door; and a stop member attached to the sill on an interior side of the ledge to retain said first door, said second door and said third door above the ledge between said stop member and the raised lip.

16. The door system as recited in claim 15 wherein said first door has two bottom corners and each of said second door and said third door has a bottom corner; and wherein said first door guide is attached at one bottom corner of said first door, said second door guide is attached at the bottom corner of said second door, said third door guide is attached at another bottom corner of said first door, and said third door guide is attached at the bottom corner of said third door.

17. The door system recited in claim 15 further comprising a first detent block located in said second track and having a surface against which said second door abuts in a closed state thereby forcing said second door against the second track which provides resistance to movement of said second door; and a second detent block located in said second track and having a surface against which said third door abuts in a closed state thereby forcing said third door against the second track which produces resistance to movement of said third door.

18. The door system as recited in claim 15 wherein each of said first door, said second door and said third door has two substantially vertical frame members; and further comprising a first wing extending from one frame member of said first door, a second wing extending from another frame member of said first door, a third wing extending from one frame member of said second door, and a fourth wing extending from one frame member of said third-door; wherein the first wing overlaps the third wing to prevent water from flowing between said first and second doors, and the second wing overlaps the fourth wing to prevent water from flowing between said first and third doors.

19. A door system for a bathing enclosure which has an opening with a sill, said door system comprising:

a track assembly extending above the opening and having a first track and a second track which is substantially parallel to the first track;

a first door suspended from and slidable along the first track and suspended above the sill;

a second door suspended from and slidable along the second track and suspended above the sill;

a detent block located in said second track and having a surface against which said second door abuts in a closed state thereby forcing said second door against the second track which produces resistance to movement of said second door;

a stop member attached to the sill and retaining said first and second doors above the portion of the sill;

a first door guide attached to said first door and having a first surface with a first tab protecting therefrom toward said second door, the first tab for abutting said second door to maintain said first and second doors spaced apart by at least a first distance; and a second door guide attached to said second door and having a second surface with a second tab protecting therefrom toward said first door, said second tab for abutting the first door to maintain said first and second doors spaced apart by at least the first distance, and wherein the first tab and the second tab engage to prevent said first door from sliding entirely past said second door.

20. The door system recited in claim 20 wherein the surface of said detent block is convex.

21. The door system recited in claim 19 wherein said detent block has an outwardly projecting ear that engages said second track to prevent movement of said detent block along said second track.

22. The door system recited in claim 19 further comprising:

a third door suspended from and slidable along the second track; and a second detent block located in said second track and having a surface against which said third door abuts in a closed state thereby forcing said third door against the second track which produces resistance to movement of said third door.

23. The door system recited in claim 22 further comprising:

a third door guide attached to said first door and having a third first surface with a third tab projecting therefrom toward said third door, the third tab for abutting said third door to maintain said first and third doors spaced apart by at least a predefined distance; and a fourth door guide attached to said third door and having a fourth surface with a fourth tab projecting therefrom toward said first door, the fourth tab for abutting said first door to maintain said first and third doors spaced apart by at least the predefined distance, and wherein the third tab and the fourth tab engage to prevent said third door from sliding entirely past said first door.

* * * * *